United States Patent [19]

Wiser

[11] 4,023,806

[45] May 17, 1977

[54] TILTABLE GAME SURFACE DEVICE

[76] Inventor: John A. Wiser, P.O. Box 192, Liberty, Tex. 77575

[22] Filed: Oct. 28, 1975

[21] Appl. No.: 625,843

[52] U.S. Cl. ..... 273/110; 273/113

[51] Int. Cl.[2] ..... A63F 7/16

[58] Field of Search ..... 273/85 R, 110, 113

[56] References Cited

UNITED STATES PATENTS

| | | | |
|---|---|---|---|
| 2,098,417 | 11/1937 | Fisher | 273/110 X |
| 2,160,299 | 5/1939 | Zinngrabe | 273/85 R |
| 2,180,123 | 11/1939 | Smith | 273/85 R |
| 3,062,312 | 10/1962 | Glass et al. | 273/110 |
| 3,463,495 | 8/1969 | Christensen | 273/110 |
| 3,539,188 | 11/1970 | Salverda | 273/110 |
| 3,787,055 | 1/1974 | Kraemer | 273/110 |
| 3,815,917 | 6/1974 | Brown | 273/110 |
| 3,931,972 | 1/1976 | Fabian | 273/110 |

FOREIGN PATENTS OR APPLICATIONS

| | | | |
|---|---|---|---|
| 526,925 | 7/1921 | France | 273/110 |
| 1,100,255 | 3/1955 | France | 273/110 |
| 1,057,725 | 10/1953 | France | 273/110 |
| 847,722 | 8/1952 | Germany | 273/110 |
| 640,361 | 12/1936 | Germany | 273/110 |
| 416,709 | 9/1934 | United Kingdom | 273/110 |
| 441,662 | 1/1936 | United Kingdom | 273/110 |

*Primary Examiner*—Richard J. Apley
*Attorney, Agent, or Firm*—Kenneth H. Johnson

[57] ABSTRACT

A tiltable game surface device comprising a cylindrical container mounted in a housing by a centrally attached spring connecting the container to a base and urging the container toward the base, and into parallel relating with the base, four levers mounted in the housing and associated with the bottom of the container about 90° apart, such that actuating one lever will cause one quadrant of the container associated with said lever to rise out of parallel with base, thereby causing a game ball on the surface to move by gravity.

6 Claims, 10 Drawing Figures

TILTABLE GAME SURFACE DEVICE

BACKGROUND OF THE INVENTION

The present invention relates to a tiltable gameboard surface to be used for a ball, such as a marble, and manipulatable through indirect means. The present tiltable surface will be adapted to have openings therein for the ball to enter. Preferably, the openings may be partially blocked by a movable means so that the ball or balls may be maintained on the surface. Games which may be played on the tiltable surface are either conventional games, such as Tic Tac Toe, or newly devised games of skill to be used with a tiltable surface.

The game surface is tiltable by manipulation of levers, so that in effect the surface is tiltable to almost any angle. This is easily achieved by the use of four levers, which are described hereinafter. The device of the present invention may be equipped with one set of levers, however, preferably there are two sets of levers, which perform duplicate functions respectively from either side of the device. Thereby allowing the game to be played by two individuals without the need for rotating the game device or movement of the individuals playing the game. In any event, the game may be played by one individual or by any number of additional individuals, either by using one group of control levers or by using the two sides of the control levers, either rotationally or otherwise.

It is the object of the game, to take a conventional game such as Tic Tac Toe which requires some mental skill to be played successfully, and to add to that skill the manipulative skill in tilting the surface of the board. Although one may have a predetermined idea or notion of where to put a particular ball in order to win a game or to block an opponent, the physical manipulation adds an extra element of chance and skill to the game of Tic Tac Toe.

There are a large number of game devices which have tiltable surfaces. These may be divided into two classes for convenience, those which are similar to the present device, in that the tilt surfaces are manipulated indirectly and which are represented by such U.S. Patents as Nos.: 2,562,126; 3,384,374; 3,643,352; and 3,787,055; and those wherein the gameboard is manipulated by direct hand tilting thereof, as represented by U.S. Pat. Nos.: 2,788,974; 3,008,716; 3,236,522; and 3,690,663.

Although the prior art patents achieve the same result, i.e., tilting of the gameboard surface, their manner of operation is for the most part very different from the present invention. The present game device is unique in that there are strategically arranged levers which are manipulated either individually or in union or sequence by the fingers of one or both hands of the player, so that the gameboard is in effect played much as one plays a piano. Operation of the game gives one much the same feeling as being a master of any keyboard in manipulating the game surface so as to achieve the desired result. Although the ultimate aim of the game is to develop a high degree of precision in manipulation of the game surface by slight and delicate pressure on the levers, even small children can quite successfully play this game, since there is an element of chance and even a skilled manipulator can fail to attain the positioning of the ball in the appropriate opening, or within a specified time.

The device is designed to be operable even on a moving vehicle such as an automobile or airplane or sea vessel.

Unlike many games of this type, the manner in which the surface is tilted can require a high degree of skill and tends to interest one much as skill games such as billiards and golf which are all basically simple, however difficult in application. In the following summary and description the game will be described in regard to a particular, highly refined embodiment, however it should be appreciated that there are a number of modifications which are within the conception of the invention, and which are readily apparent to one after reviewing the drawings and specification. For example the present invention will be described in regard to a playing surface within a cylindrical container. Although this is preferred it is readily apparent that a rectangular, square, triangular or other shape of playing surface could just as easily be employed. For these various shapes, excluding the triangle, the four lever arrangement to be described would be employed. However for the triangular playing surface only a three lever arrangement need be employed, which would be manipulated by the fingers of one hand, in the same manner as to be described hereinafter, with one lever each controlling a point of the triangle. Other obvious modifications which are within the scope of the present invention include the arrangement of the openings on the game surface. As shown in the drawings and used to describe the present mechanism, an arrangement suitable for playing Tic Tac Toe is provided. However the game surface could be arranged with random holes placed thereon and barriers on the surface, with various point indications for various openings. In fact it is within the purview of the present invention to have a removable game surface wherein a number of games could be played thereon using the device by changing the surface. Other refinements depicted in the drawings, which are not necessary, are shooting devices for placing the game ball onto the surface (it is readily appreciated that the game ball could merely be placed at a neutral portion of the surface by hand, and the manipulation begun at that point. Another refinement is the use of leveling devices, which although useful would not be necessary, provided the same starting point was used by each of the players.

SUMMARY OF THE INVENTION

Briefly described the present invention is a tiltable game surface device, wherein the game surface is movably mounted in relation to a base. At least three lever means are provided to raise the game surface at least at three points, each of said points being at least 60° apart. More specifically the invention is a tiltable game surface device comprising a base, a container having a wall and a bottom, movably mounted to said base, a game surface member having an opening therein and seated in said container, and at least three lever means mounted on said base, each of said lever means associated with said container at a different point and at least 60° apart from the other lever means and preferably at or near the periphery of the bottom of the container.

The container is preferably cylindrical, however it may be square, rectangular, triangular, octagonal, or the like. The container has a bottom and may have a transparent cover which is either fixed or removable. The game surface is seated in the container below the top thereof so that the container wall encloses the game surface. The container is mounted in the base by a biasing means such as a helical coil spring so that the game surface is substantially parallel to the base when the lever means are at rest. Thus if the base is leveled, the game surface will be level. The game surface may be fixedly or removably seated in the container. It is preferable that the game surface be removable so that game surfaces for different games may be placed therein as desired.

In a preferred embodiment a releasable closure means is provided to partially block the holes in the game surface so that the game ball or balls will remain seated on the game surface, i.e., seated in the depression formed by the hole. Upon release of the closure means, openings therein line up with the openings in the game surface and the game ball or balls drop through into the container and are recovered therefrom for reuse.

It is of course contemplated that an inexpensive version of the present invention would have openings in the game surface which were only indentation designed to hold a game ball and recovery of the ball would be by removing the ball from the opening. It has been found, however, that a releasable closure means is a convenient way to quickly clear the game board and collect all of the game balls in one location. Hence the term opening, as used herein, includes holes and indentations. Of course any hole can be employed as described above as merely an indentation by using balls of diameter greater than the hole diameter.

The present inventor realizes that much of the permutation description set out is readily apparent or statement of obvious fact, however, the invertor wished to point out that the basic invention is in relation to the means of manipulation of the container, i.e., the game surface, to bring a ball into an opening. A further particular embodiment as disclosed and claimed relates to a releasable closure means associated with the game surface. Other embodiments are described and claimed herein also, which tend to be further improvements on the basic invention.

DRAWINGS

DETAILED DESCRIPTION OF THE INVENTION

Figure 1:
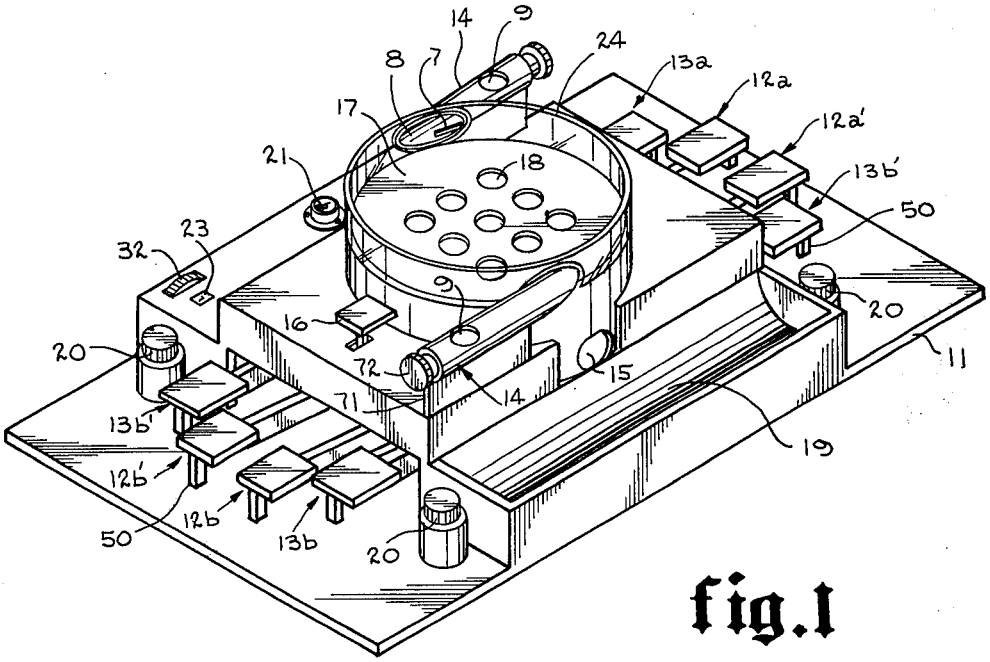
FIG. 1 is a perspective view of one embodiment of the present tiltable game board device showing a circular game board with an arrangement of openings therein, suitable for playing Tic Tac Toe, and tiltable by operation of four levers on opposed ends of the device.
Figure 9:
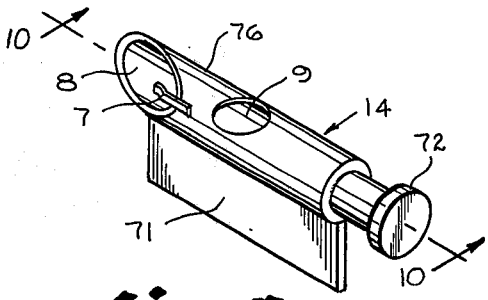
FIG. 9 is a perspective detail of the shooting device used to inject a game ball onto the game surface.
Figure 10:
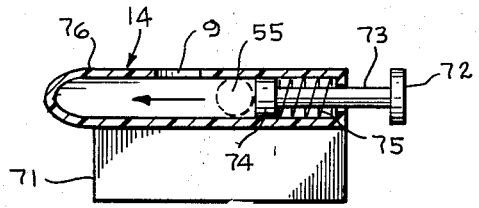
FIG. 10 is a cross-sectional view taken along line 10—10 of FIG. 9, showing the game ball seated in the device used to shoot the game ball onto the game surface.

The present invention may be best understood by reference to the drawings. Referring now to FIG. 1, the present tiltable game surface device is shown in perspective. The game is played with a ball (not shown) such as a marble, which is placed onto the game surface by putting the marble into the shooter 14. The shooter is a more or less conventional plunger type spring actuated device found in marble games. Referring now to FIGS. 9 and 10, the shooter 14 is shown in detail. The shooter is comprised of a tube 76 having an opening 9 therein through which a ball 55 is placed into the shoot 14 as shown in FIG. 10. The handle 72 is connected to a rod 73 which terminates in plunger 74. The plunger is biased against helical compression spring 75 which when compressed and released by hand will throw the ball 55 along the tube 76 past gate 7 through opening 8 onto the game surface 17. The gate 7 is placed to extend over a portion of the opening 8 in order to prevent a ball from reentering tube 76 from the game surface 17. The shooter 14 is mounted to housing 22 by means of fin 71.

Figure 8:
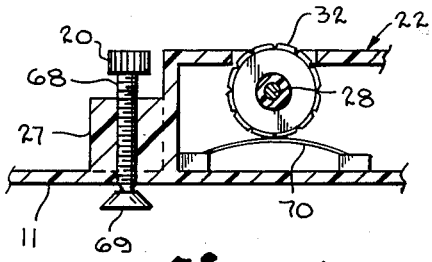
FIG. 8 is a cross-sectional detail of the game counter device.

Before the ball is placed onto the game surface 17 the game device 10 may be leveled by means of the leveling legs 20 located at four points 90° apart on the base 11 of the game device 10. Referring now to FIG. 8, the leveling leg is shown in detail. Leveling leg 20 is comprised of a threaded bolt 68 passing through threaded bushing 27 and terminating below the base 11 in a foot 69 which is attached to the lower end of the bolt. The foot is designed to engage the surface upon which the game device 10 is placed. Leveling is achieved by adjusting the four leveling legs until the bubble 21 is approximately centered.

Once the ball is on the game surface, the object of the game is to manipulate the level of the surface, thereby causing the ball to enter into one of the openings 18 on the game surface 17. This is done by a player manipulating one set of lever assemblies 12 and 13. By depressing the lever assemblies a portion of the container 24 is caused to rise out of its substantially parallel normal at-rest position with the base 11, thereby causing the ball to roll by means of gravity about the surface. In the drawings the levers designated 12, both **12*a*, 12*b*, 12*a'*, and 12*b'* are the proximal lever assemblies, which when depressed cause a portion of the container 24 adjacent to the levers to rise out of its level configuration. The 13 levers, i.e., 13*a*, 13*b*, 13*a'* and 13*b'*, are the distal levers which when actuated by downward pressure of the hand cause a distal portion of the container 24** to rise out of the level configuration.

Figure 2:
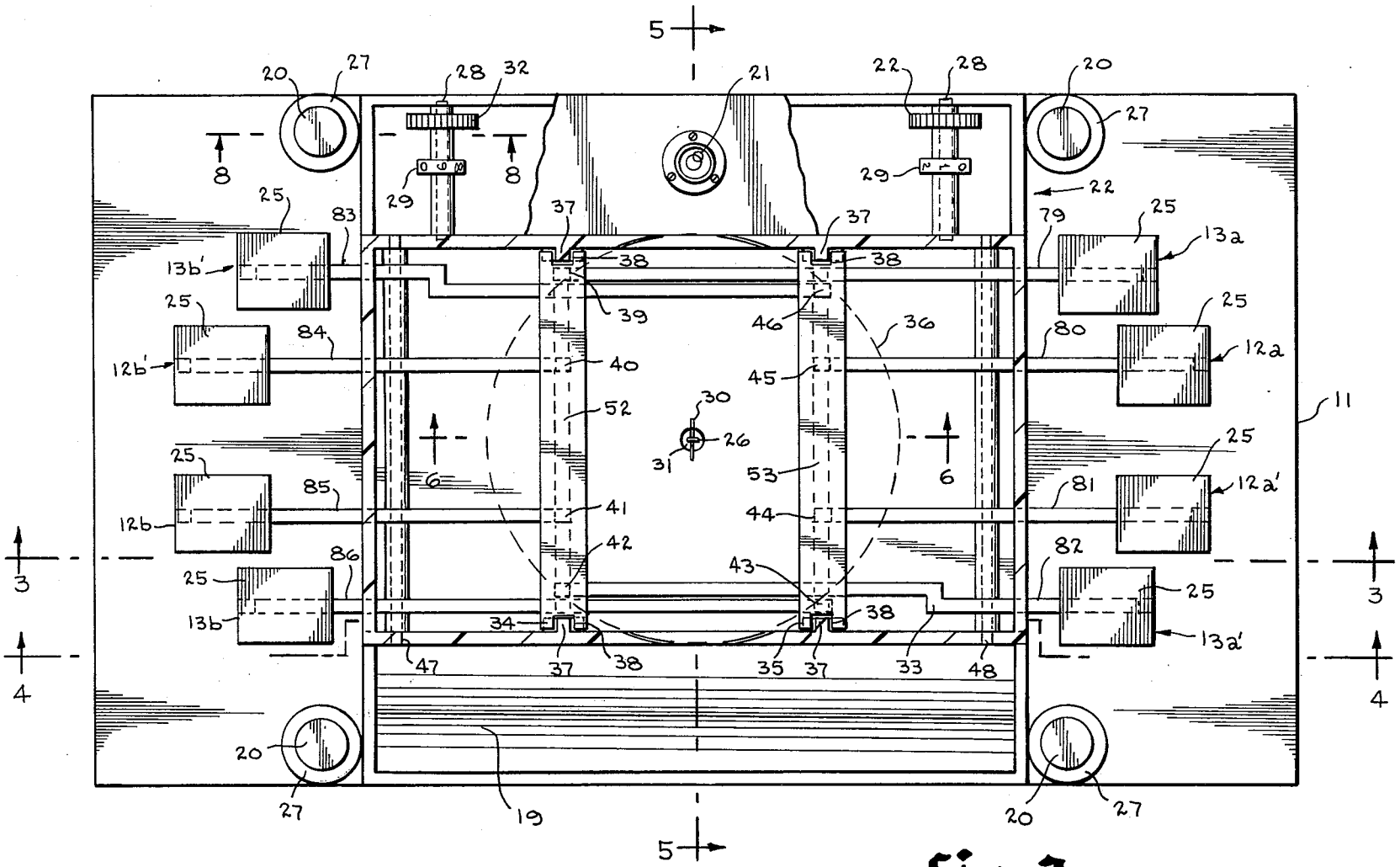
FIG. 2 is a top view in plan, showing in particular the arrangement of levers in regard to the tiltable container holding the game surface.

Referring now to FIG. 2, the operation of the lever assemblies will be described in more detail. FIG. 2 is an in plan top view of the device. The container 24 is represented by the dotted line 36 which shows the approximate location of the container in regard to the various lever assemblies. The *a* side of the device is to right of FIG. 2 and the *b* side to the left. Each lever assembly is comprised of a tread 25 and an arm associated as follows: arm 79, 80, 81, 82, 83, 84, 85, and 86 and lever assembly 13*a*, 12*a*, 12*a'*, 13*a'*, 13*b'*, 12*b'*, 12*b*, and 13*b* respectively. As hereinbefore stated the 13 levers are all distal levers. This can be seen in FIG. 2 as follows: lever assembly 13*a* has the arm 79 which extends under the container 24 and contacts beam 34 at point 39. When the lever assembly 13*a* is actuated by downward pressure of the hand, the lever rotates about rod 53 upon which it is pivotally mounted, thereby causing point 39 to force beam 34 upward, thereby raising that corner of the container. Similarly when lever assembly 13*a'* is actuated, it rotates about rod 53 (FIG. 4) and forces the beam 34 upward against the container at point 42, thereby raising that quadrant of the container 24. If both 13*a* and 13*a'* are pressed at the same time, either with the same degree of downward movement or with varying degrees of downward movement, the entire distal side of container 24 will be forced upward by the pressure of the arms 79 and 82 at points 39 and 42 respectively, against beam 34.

The 12 levers, as stated hereinbefore, are the proximal lever assemblies. When lever 12*a* is depressed it rotates about rod 48 on which it is pivotally mounted, thereby causing the arm 80 to force beam 35 upward by the contact at point 45, and subsequently forcing the container 24 upward at this point. Again if lever assembly 12*a'* is actuated, either independently or at the same time as lever 12*a*, the beam 35 is forced up by contact with the arm 81 at point 44, raising that quadrant of the container 24.

Figure 4:
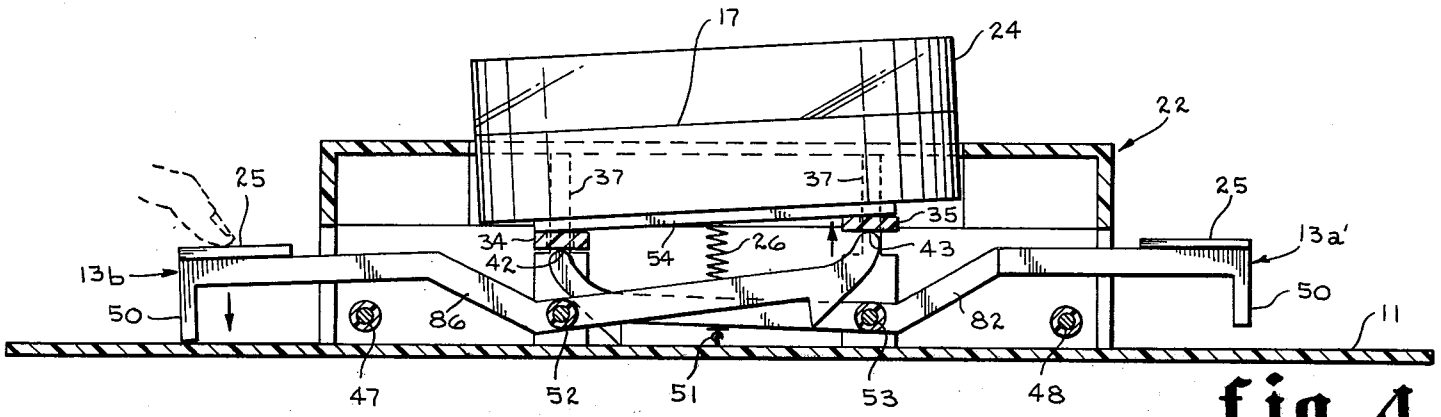
FIG. 4 is a cross-sectional elevation of the present device showing a different set of levers in one mode of hand manipulation, taken along line 4—4 of FIG. 2.

By the same analysis, the operation of the 12*b*, 12*b'*, 13*b* and 13*b'* can be made. The two ends of the device depicted in this embodiment are the reversed mirror images. Note for example that lever assemblies 13*a'* and 13*b'* are distal levers, contacting their respective beams 34 and 35 inside of the adjacent lever arms and both have angles 33 in the arm to allow the respective arms to go around the incoming lever arm from the opposite side. The 12*b*, 12*b'*, 13*b* and 13*b'* lever assemblies are pivotally mounted on rods 47 and 52 respectively. (FIG. 4 shows rod 52.) Each lever assembly has a stop 50 which prevents its movement downward any further than the stop, which would come to rest against the base 11 thereby allowing an equal amount of movement by each of the levers up to the maximum allowed by the stop. The levers are maintained in the at-rest position as shown for example in FIG. 1 by biasing means such as coil springs attached to the lever arms as appropriate and by means of a particularly strong coil spring 26 attached to the bottom of container 24 by means of a pin 30 securing the spring in the bottom of container 24 through hole 31, as shown in FIG. 2. The beams 34 and 35 are attached to neither the lever arms 33 nor to container 24, but are allowed to move freely between the two and ride on ribs 37 along slots 38 in each of the beams. It is readily apparent, as stated above, that the manipulation of lever 13*b'* will cause the beam 35 to rise at a point 46; manipulation of lever assembly 12*b* will cause beam 34 to rise at point 40; manipulation of lever 12*b* will cause beam 34 to rise at point 41; and finally manipulation of lever assembly 13*b* will cause beam 35 to rise at point 43.

In actual operation of the game device, once one has become somewhat adept and skilled at its handling, all of the levers on one side are arranged to be manipulated by the fingers of one hand; thereby by varying the amount of pressure and the combination of lever assemblies which are depressed one can very accurately, with practice, move the ball about the game surface, with an almost surprising degree of control over the ball.

As stated hereinbefore the purpose of the manipulation of the ball on the game surface 17 is to seat the ball in the opening in the game surface. In the embodiment shown in the Figures of the present application, the openings are arranged for a game such as Tic Tac Toe. Thus it is the purpose of the manipulation of the game surface to manipulate the ball into one of the openings. (there of course could be more than one ball present on the game surface at a time, thereby compounding the difficulty in manipulating the ball thereon). It is within the scope of this invention that the game ball could merely drop into the opening and fall through into a container, or to fall through an opening and to pass out through a ball return opening 15 into the ball receptacle 19. However it is preferable, particularly if a game pitting one player against another player is to be carried out, or one player against the clock, to have the game ball seat into an opening but not fall through into the container. This is obtained by means of a closure plate 56 which is mounted preferably onto the game surface within the container.

Figure 5:
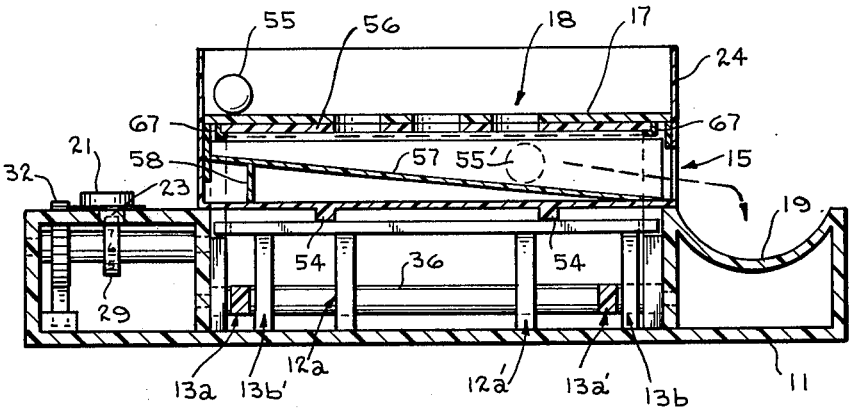
FIG. 5 is a cross-sectional elevation of the device taken along line 5—5 of FIG. 2.
Figure 6:
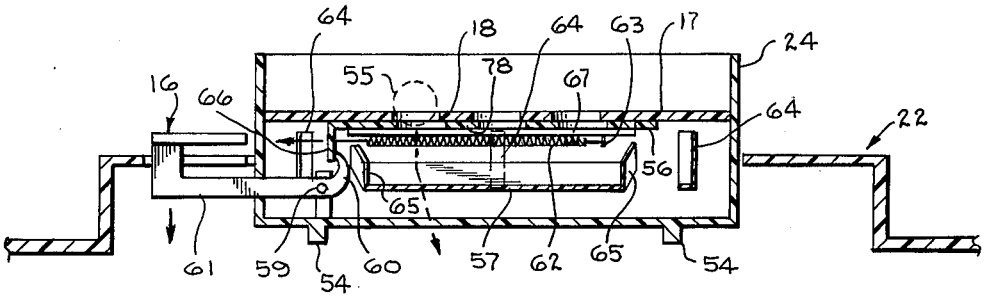
FIG. 6 is a detailed cross-sectional elevation of the release mechanism for the game surface for the embodiment shown in FIG. 1.

The closure plate in its closed configuration is best seen in FIG. 6, which describes the release mechanism as depicted in FIG. 1 of the present invention. The game surface 17 is shown seated on supports 64 located about the internal wall of the container 24. The game surface can be affixed to the container, however in order to allow different game surfaces be seated therein, it is best removably mounted in the container. The closure plate consists of openings, i.e., holes, 78 therein which are arranged to correspond to the holes or openings 18 in the game surface 17. In FIG. 6, the closure plate is shown to be in its closed position wherein the holes 78 are offset from the holes 18 in the game surface, thereby forming a seat into which a ball 55 will seat, which by selection of the appropriate size ball will not pass through the two openings until they are aligned. The closure plate is held out of alignment by means of tension coil spring 62 which is mounted at point 63 to guide 67 which is affixed onto the game surface 17. There is a guide 67 as shown in FIG. 5 on two sides of the closure plate 56 which forms a channel between itself and the game surface 17 along which the closure plate can slide. Thus the closure plate is slidably mounted into this channel along the game surface within the container 24. There is a spring 62 as stated, which is mounted to the guide 67 and attached to the flange 66 of the closure plate, thereby biasing the closure plate out of alignment so that the holes 78 therein are out of alignment with the holes or openings 18 in the game surface.

In order to bring the openings in the game surface and the closure plate into alignment the game surface ball release lever assembly 16 is actuated by downward pressure, thereby causing it to rotate about pin 59 bringing the hook end thereof 60 into contact with flange 66 thereby forcing flange 66 and closure plate 56 in the direction of the arrow shown in FIG. 6 and bringing the holes 78 and holes or openings 18 into alignment, allowing ball 55 to pass through the openings which now form a hole connecting into the interior of the container 24. The ball or balls 55 fall as shown by the arrow onto plate 57 which serves as a chute having sides 65 to deliver the ball as shown in FIG. 5 to ball return opening 15 and thereby into the ball receptacle 19 (FIG. 1). The plate 57 is held in position by a support such as 58 as shown in FIG. 5. When the game surface ball release lever assembly 16 is released, the tension spring 62 will bias the closure plate 56 back into its at-rest position, thereby offsetting the openings 78 and 18, and closing the game surface holes, making them merely openings into which a ball will seat again.

Figure 3:
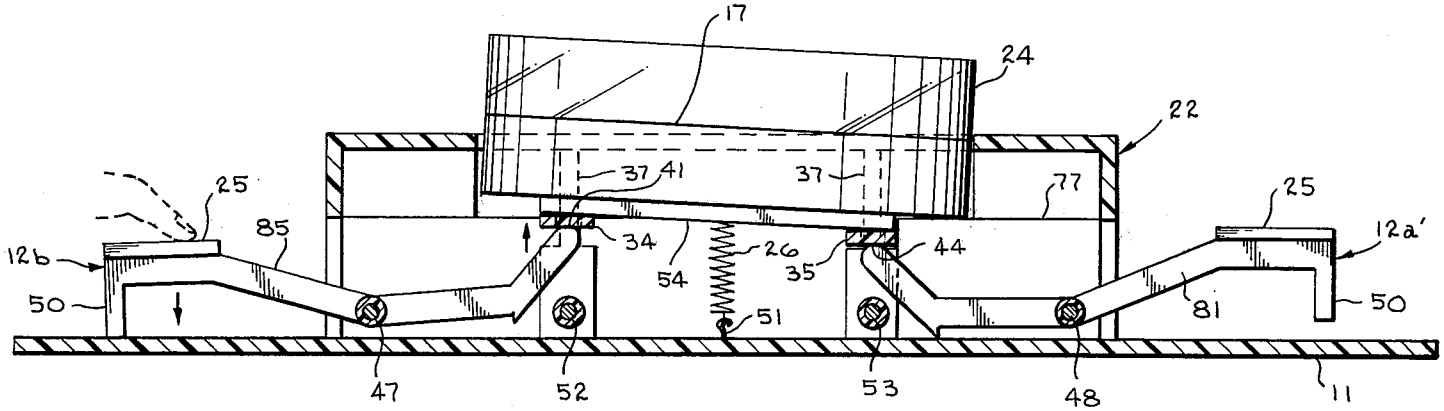
FIG. 3 is a cross-sectional elevation of the device of the present invention showing the relationship of the levers to the tiltable game board surface container, in one mode of operation by hand manipulation, taken along line 3—3 of FIG. 2.

The operation of a lever system as in the present device may better be seen in regard to FIGS. 3 and 4. In FIG. 3 which is a side elevation taken along line 3—3 of FIG. 2, the location of two of the proximal level assemblies, 12*a'* and 12*b*, are depicted. In this configuration the lever assembly 12*b* has been shown to be manually depressed to the limit allowed by stop 50, thereby causing arm 85 to rotate about rod 47 bringing the end of the arm corresponding to point 41 of FIG. 2 to bear against the beam 34, thereby causing the proximal side in regard to the pressed lever of container 24 to rise out of its at-rest, level configuration thereby tilting the game surface 17. When the manual pressure is released from lever 12*b* by tension spring 26 which is connected to base 11 via hook 51 will cause the container 24 to return to its at-rest position by forcing the beam 34 downward, thereby rotating arm 58 about rod 47 and bringing lever assembly 12*b* back to its normal at-rest position.

FIG. 4 is a side elevation of the device taken along line 4—4 of FIG. 2 distal lever 13*b* is shown depressed to the maximum extent allowed by stop 50, thereby causing arm 86 to rotate about rod 52 causing the end of arm 86 adjacent to the container corresponding to point 43 on FIG. 2 to force beam 35 upward, thereby raising the distal portion of the container in regard to the manipulation of the lever 13*b* out of level at-rest configuration. Thus thereby the game surface 17 is tilted out of a level configuration since the game surface is substantially parallel with the bottom of the container, which in turn is substantially parallel with base 11, thereby allowing a ball on the surface to roll toward the manipulator by operation of gravity. Similarly as described hereinabove upon release of the lever assembly 13*b*, the tension spring 26 would bring the container 24 to its at-rest configuration in the housing 22 wherein it will sit on ledge 77 which extends in the housing about the entire periphery of the container and is itself substantially parallel with base 11, thereby forcing lever 86 to rotate about rod 52 bringing the lever assembly 13*b* back to its at-rest position, which will be substantially the same as shown in FIG. 4 for lever assembly 13*a'*.

Figure 7:
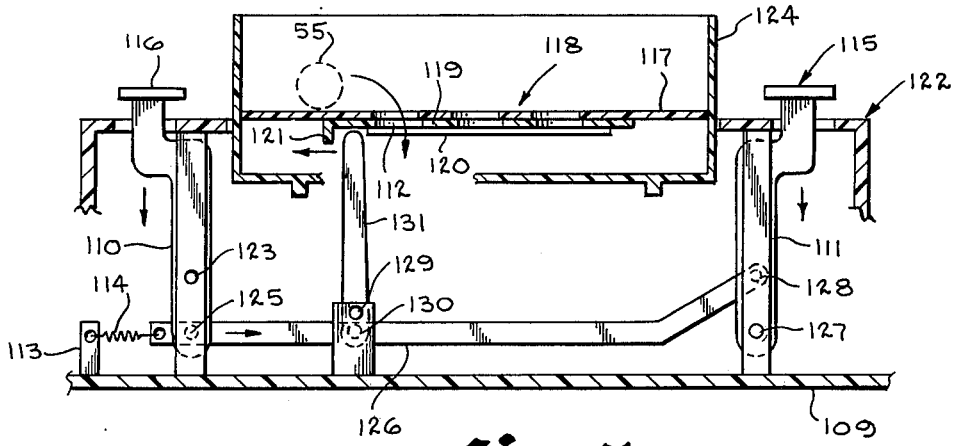
FIG. 7 is an alternate release mechanism having two external release levers, one being adjacent to each end of the game device.

FIG. 7 shows an alternative release mechanism, which would provide a game surface ball release lever 116 and 115 respectively, on both sides of the device. Release lever assemblies 116 and 115 operate off of the same rod 126 which actuates a single release arm 131. The release mechanism operates in this manner: the closure plate 121 is mounted in the same fashion as the corresponding closure plate shown in FIG. 6 and is biased in the same manner with guide members corresponding to those shown in FIG. 6 but not shown here. The alternate configuration is in regard to the game surface ball release lever assemblies. As shown in the FIG., game surface ball release lever assembly 116 comprise an arm 110 which is pivotally mounted at 123 in the housing 122. The rod 126 is pivotally mounted to the lower end of the arm 110 below point at which arm 110 is mounted in the housing 122. In order to maintain the release mechanism in its at-rest or closed position the rod 126 is biased by a tension spring 114 mounted to post 113 mounted to base 109. Rod 126 is pivotally attached to arm 131 which arm is pivotally mounted in the housing 122 at flange 121. The rod 126 is also pivotally attached to game surface ball release lever assembly 115 at point 128. The game surface ball release assembly 115 comprises arm 111 to which rod 126 is attached at point 128. The arm 111 is pivotally mounted in the housing 122 at point 127 which is below the pivotal connection to rod 126. Thus the two game surface ball release lever assemblies 115 and 116 are both connected to rod 126 and are pivotally mounted in the housing so that the downward pressure on both assemblies will cause them to rotate in the same direction about their pivotal mounting points in the housing thereby both causing rod 126 to move in the direction of the arrow thereon which causes arm 131 to rotate in the direction of the arrow thereby contacting flange 121 causing the holes 112 in closure plate 119 to align with the openings or holes 118 in game surface 117, thereby allowing the ball 55 to pass through the aligned holes and into the container to a retrieval point as described hereinabove.

Referring now to FIG. 8 the scoring device is shown in some greater detail. The scoring device is comprised of a scorer which is pivotally mounted onto a rod 28 which is pivotally mounted in the housing 22 as shown in FIG. 1. Also fixedly attached to the rod is score wheel 29 which has a series of numbers around the surface thereof, which can be changed and brought into alignment with score display window 23 as shown in FIG. 1 by rotation of scorer 32. In FIG. 8 a brake 70 is shown which provides a small amount of friction for scorer 32 thereby allowing it to turn, but holding it at the desired score so that it is not inadvertently changed.

It is readily apparent that there are many reversals of parts which could be carried out here so that the same functions and method of operation of the present device are achieved. These parts reversals are within the scope of the invention contemplated. Furthermore, a number of variations have been described hereinbefore, however are not depicted since they are quite adequately comprehended when they are described by the written word in the specification. These modifications are also contemplated and are within the scope of the claim as set forth herein.

The invention claimed is:

1. A tiltable game surface device comprising:

a base, a housing mounted on said base, a container having a bottom and wall mounted in said housing and movable therein, a biasing means connecting said container to said base thereby biasing said container toward said base, a game surface member having a plurality of holes therein and seated into said container, below the top of the wall, such that said container wall encloses said game surface member, a closure plate slidably mounted to said game surface member and having holes therein alignable with the holes in said game surface member, a biasing means tending to urge said holes in said closure plate out of alignment with the holes in said game surface member, a means for actuating said closure plate to align said holes therein with the holes in said game surface member and at least a first group of four adjacent levers pivotally mounted on said base and extending from said housing and into said housing below said container, said levers being arranged to separately contact points adjacent to the bottom of said container at points at least 60° apart, for individually raising the container at their respective contact points.

2. The tiltable game surface device according to claim 1 having a second group of four adjacent levers.

3. The tiltable game surface device according to claim 2 having a means for actuating said closure plate, associated with each set of levers.

4. A tiltable game surface device comprising:

a base, a housing mounted on said base, a container having a bottom and wall mounted in said housing and movable therein, a biasing means connecting said container to said base thereby biasing said container toward said base, a game surface member having a plurality of holes therein and seated into said container, below the top of the wall, such that said container wall encloses said game surface member, a closure plate slidably mounted to said game surface member and having holes therein alignable with the holes in said game surface member, a biasing means tending to urge said holes in said closure plate out of alignment with the holes in said game surface member, a means for actuating said closure plate to align said holes therein with the holes in said game surface member and at least a first group of four adjacent levers pivotally mounted on said base and extending from said housing and into said housing, two of said levers extending under said container and being operably associated with a distal bottom portion of said container from the point where said levers are pivotally mounted, and two of said levers extending under said container and being operably associated with a proximal bottom portion of said container from the point where said levers are pivotally mounted, each of said levers being associated with a separate quardrant of said container for raising said quadrant.

5. The tiltable game device according to claim 4 having a second group of four adjacent levers mounted to said housing opposite to the first group of four adjacent levers.

6. The tiltable game device according to claim 4 wherein said levers are arranged to contact points adjacent to the bottom of said container at points at least 60° apart.

* * * * *